US006456693B1

(12) United States Patent
Ratzmann et al.

(10) Patent No.: US 6,456,693 B1
(45) Date of Patent: Sep. 24, 2002

(54) MULTIPLE ROW SPIRAL GROOVE BEARING FOR X-RAY TUBE

(75) Inventors: Paul M. Ratzmann, Germantown, WI (US); Douglas J. Snyder, Brookfield, WI (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 09/681,466

(22) Filed: Apr. 12, 2001

(51) Int. Cl.[7] ..... H01J 35/10
(52) U.S. Cl. ..... 378/132; 378/133
(58) Field of Search ..... 378/132, 133, 378/119, 200, 202; 384/901, 99, 100

(56) References Cited

U.S. PATENT DOCUMENTS 3,631,765 A * 1/1972 Neumeister ..... 92/52
5,091,927 A 2/1992 Golitzer et al.
5,384,818 A * 1/1995 Ono et al. ..... 378/132
5,828,148 A * 10/1998 Niggemann et al. ..... 310/86

* cited by examiner

*Primary Examiner*—Robert H. Kim
*Assistant Examiner*—Hoon K. Song
(74) *Attorney, Agent, or Firm*—Peter J. Vogel, Esq.

(57) ABSTRACT

A multiple row spiral grooved bearing assembly 26 for use in a rotating anode X ray tube device 10 has an intermediate race 32 having a spiral grooved inner 34 and outer 36 surface placed between an outer housing 28 and an inner bearing shaft 30. A layer of gallium 42, 44 is interposed between the spiral grooved inner surface 34 and the inner bearing shaft 30 and between the spiral grooved outer surface 36 and outer housing 28 to provide lubrication for the surfaces of the intermediate race 32. The intermediate race 32 reduces the relative velocity between moving parts, thereby reducing heat generation of the bearing assembly 26 for a given anode rotation speed. This enables higher target 14 velocities, and hence higher focal spot power, available to the x-ray tube device 10 as compared with traditional ball-type bearing designs.

18 Claims, 2 Drawing Sheets

MULTIPLE ROW SPIRAL GROOVE BEARING FOR X-RAY TUBE

BACKGROUND OF INVENTION

The present invention relates generally to a radiography device and, more particularly, to a radiography device having a multiple row spiral groove bearing for an X-ray tube.

The X-ray tube has become essential in medical diagnostic imaging, medical therapy, and various medical testing and material analysis industries. Typical X-ray tubes are built with a rotating anode structure for the purpose of distributing the heat generated at the focal spot. The anode is rotated by an induction motor consisting of a cylindrical rotor built into a cantilevered axle that supports the disc-shaped anode target, and an iron stator structure with copper windings that surrounds the elongated neck of the X-ray tube that contains the rotor. The rotor of the rotating anode assembly being driven by the stator which surrounds the rotor of the anode assembly is at anodic potential while the stator is referenced electrically to the ground. The X-ray tube cathode provides a focused electron beam that is accelerated across the anode-to-cathode vacuum gap and produces X-rays upon impact with the anode.

In an X-ray tube device with a rotatable anode, the target has previously consisted of a disk made of a refractory metal such as tungsten, and the X-rays are generated by making the electron beam collide with this target, while the target is being rotated at high speed. Rotation of the target is achieved by driving the rotor provided on a support shaft extending from the target. Such an arrangement is typical of rotating X-ray tubes and has remained relatively unchanged in concept of operation since its induction.

Inner rotation bearings for use in a rotating anode x-ray tube device are well known in the prior art. One typical type of x-ray tube support bearing includes ball bearings positioned between an inner and outer race to provide bearing support for the assembly. Although such bearing designs are common, they are not without disadvantages.

It is possible for present bearing designs to transfer torque through the ball bearings to the outer race. This transfer of torque can result in the rotation of the outer race that may in turn contribute to chatter of the bearing assembly. This is highly undesirable. In addition, present designs with a stationary, or nearly stationary, outer race may result in high velocities of the ball bearings during operation. The combination of rubbing due to race rotation, chatter, and high ball velocities can result in high acoustic noise generation during operation. This is, of course, highly undesirable.

Considerable effort and time has gone into the advancement of systems to lubricate the ball bearings in such designs in an effort to reduce these negative characteristics. These advancements in lubrication, however, can come at the expense of an increase in cost of the bearing assembly. In addition, such lubrication systems often leave room for improvement in the reduction of ball speed, torque transfer, and chatter. Reductions in such characteristics are highly desirable as they may lead to reduced wear on the ball bearings, an increase in the life cycle of the bearings, a reduction in acoustic noise generation, and possibly an increased anode run speed of the tube.

Therefore, there is a need for an X-ray tube bearing assembly that reduces ball speed, reduces transfer torque, reduces chatter, reduces acoustic noise generation, and may allow for an increase in the anode run speed of the tube.

One approach that has been used to increase the performance of rotating anode X-ray devices is to replace ball bearing type bearing assemblies with a spiral groove bearing. Spiral groove bearings are typically used in X-ray tubes as a means to run the tube very quietly. The spiral groove is a hydrodynamic bearing that typically uses gallium as a fluid interface. However, these bearings are typically speed limited, as higher speed operations can lead to excessive turbulence of the liquid, higher heat generation, and higher torques that affect the spiral groove bearing performance.

Another approach to improving the performance of the bearing assembly is discussed in copending U.S. application Ser. No. 09/751,976, entitled "Multiple Row X-Ray Tube Bearing Assembly", filed Dec. 29, 2000, in which the use of multiple row x-ray tube bearings, as compared with a single row, is proposed. The introduction of an intermediate freely rotating inner race allows each bearing row to rotate independently of each other. This can reduce ball velocity, outer race rotation, rubbing, and chatter. This bearing assembly may also allow for increased anode speed runs.

It is thus highly desirable to design a system that incorporates all the benefits of a multiple row X-ray bearing assembly with a spiral groove type bearing.

SUMMARY OF INVENTION

The present invention incorporates at least one dual spiral groove intermediate race into an X-ray tube assembly.

The introduction of an intermediate race having an outer and inner spiral grooved surface reduces the relative velocities and increases the overall speed capability in the bearing assembly. This enables higher target (shaft) velocities and corresponding higher focal spot power while reducing heat generation and torque requirements. All of these factors are improved because torque and power do not scale linearly with speed.

Other objects and advantages of the present invention will become apparent upon the following detailed description and appended claims, and upon reference to the accompanying drawings.

DETAILED DESCRIPTION

Figure 1:
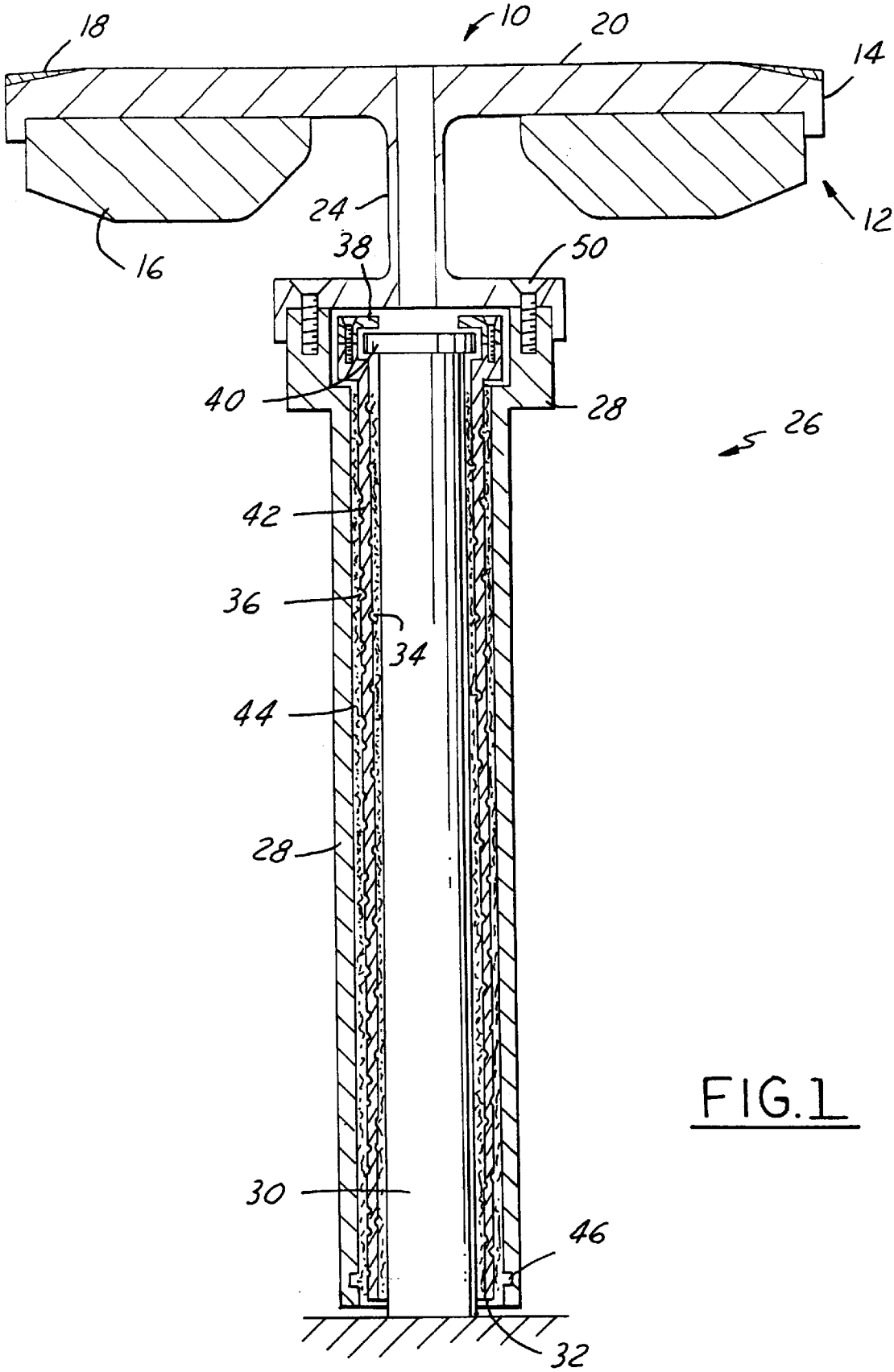
FIG. 1 is a cross-sectional view of a multiple row bearing assembly for use in a x-ray tube device according to one preferred embodiment of the present invention.

Referring now to FIG. 1, an X-ray tube device 10 is depicted having a rotating anode assembly 12. The rotating anode assembly 12 has a tungsten-rhenium area 18 for generating X-rays, a target 14 having a molybdenum alloy substrate 20 for structural support, and a graphite disk 16 operating as a heat sink. The graphite disk 16 is joined to the molybdenum alloy substrate 20 using a braze alloy (not shown). Further, a stem 24 joins the target 14 to the outer housing 28 of a multiple row bearing assembly 26.

The multiple row bearing assembly 26, according to a preferred embodiment of the present invention, is shown in which the outer housing 28 is coupled to the rotor (not shown) while an inner shaft 30 remains stationary. The intermediate race 32 has an inner spiral grooved surface 34 and an outer spiral grooved surface 36 and is coupled to an end piece 38 that retains the intermediate race 32 to the end 40 of the inner shaft 30. A layer of gallium (not shown) is interposed between the end piece 38 and the inner shaft 30. The outer housing 28 is coupled to the stem 24 of a rotating anode assembly 12 preferably using bolts 50 as the coupling devices. A layer of gallium 42 is interposed between the inner spiral grooved surface 34 and the inner shaft 30 and a second layer of gallium 44 is interposed between the outer spiral grooved surface 36 and the outer housing 28. The outer housing 28 also may have a capture reservoir 46 that functions to trap gallium that may leak out during rotation of the outer housing 28. In an alternative embodiment not shown, the capture reservoir may be located on the intermediate race 32. Similarly, another embodiment could have a capture reservoir 46 located on both the outer housing 28 and intermediate race 32.

Figure 2:
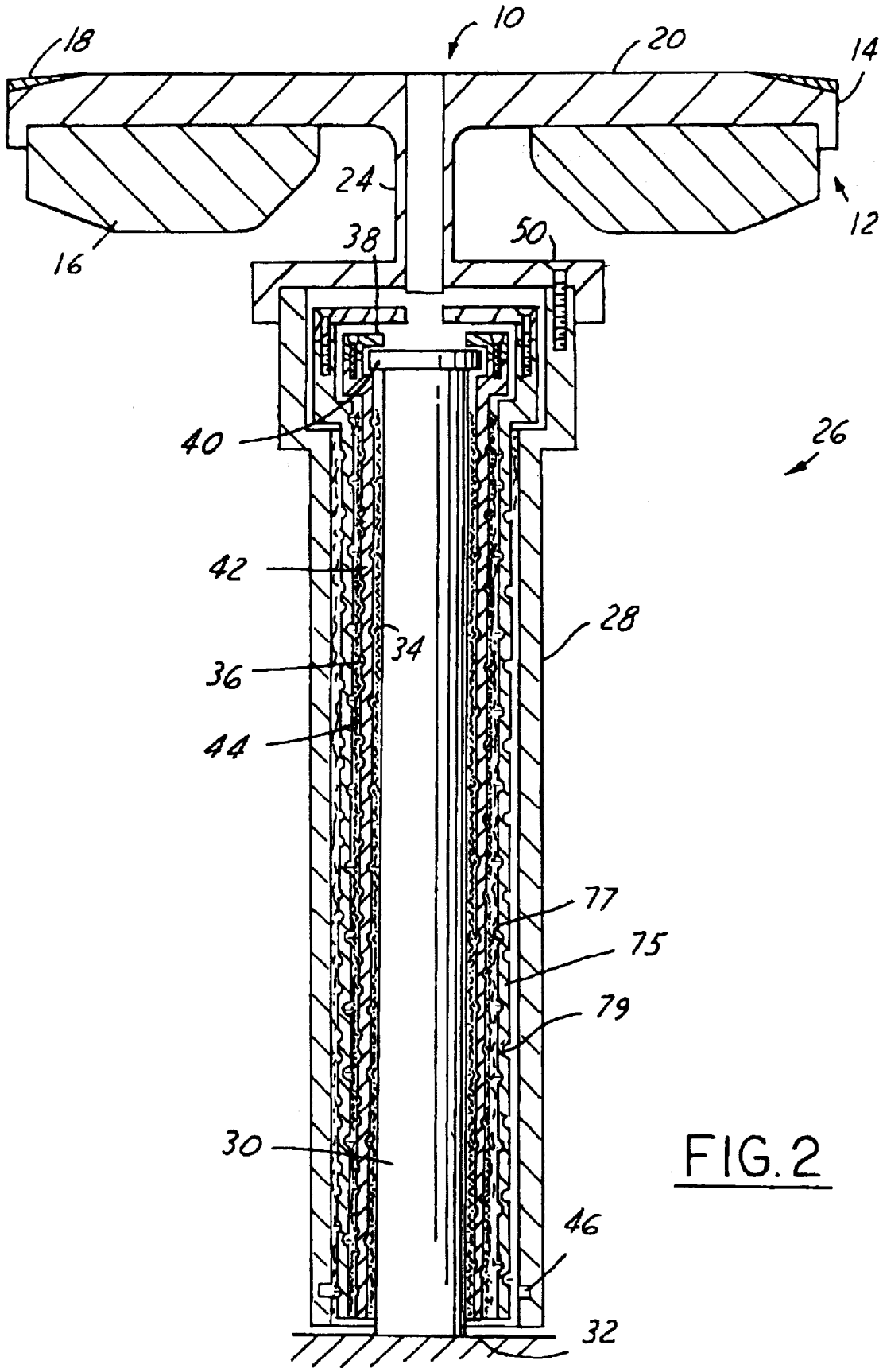
FIG. 2 is a cross-sectional view of a multiple row bearing assembly for use in a x-ray tube device according to another preferred embodiment of the present invention.

In another preferred embodiment of the present invention, as shown in FIG. 2, it is contemplated that an additional intermediate race 75 may be laid end to end to the intermediate race 32. This additional intermediate race 75 also preferably has an inner spiral grooved surface 77 and an outer spiral grooved surface 79, along with additional layers of lubricating gallium. This additional intermediate race 75 can provide additional torque prevention to the inner shaft 30 and may simplify manufacturing. Further, it is contemplated that additional intermediate races (not shown) may be added that are contained within the outer housing 28, along with additional layers of lubricating gallium, to provide additional torque reduction to the inner shaft 30.

In addition, it is specifically contemplated that a multiple row bearing assembly could be formed having an inner rotating shaft coupled to the rotor and a stationary outer housing, as opposed to a stationary inner shaft 30 and rotating outer housing 28 as contemplated in FIGS. 1 and 2. The intermediate race, or races, having an outer spiral grooved surface, inner spiral grooved surface, is coupled between the stationary outer housing and rotating inner shaft. As above, layers of gallium would be added as lubrication. This embodiment would limit the operating torque and heat generation in the gallium and would permit an overall velocity increase of the target in substantially the same manner as contemplated in FIGS. 1 and 2.

In addition, it is specifically contemplated that a multiple row bearing assembly could be formed having an inner rotating shaft coupled to the rotor and a stationary outer housing, as opposed to a stationary inner shaft 30 and rotating outer housing 28 as contemplated in FIG. 1. The intermediate race having an outer spiral grooved surface, inner spiral grooved surface, is coupled between the stationary outer housing and rotating inner shaft. As above, layers of gallium would be added as lubrication. This embodiment would limit the operating torque and heat generation in the gallium and would permit an overall velocity increase of the target in substantially the same manner as contemplated in FIG. 1.

The introduction of an intermediate race having an inner and outer spiral grooved surface reduces the relative velocities and increases the overall speed limitations in the bearing assembly. This enables higher target (shaft) velocities and corresponding higher focal spot power while reducing heat generation and torque requirements. All of these factors are improved because torque and power do not scale linearly with speed. Further, because there is less drag with the introduction of the intermediate race as compared with traditional ball-type bearing assemblies, a smaller motor may be used to rotate the anode assembly. This increases the cost effectiveness of the x-ray target assembly.

While one particular embodiment of the invention have been shown and described, numerous variations and alternative embodiments will occur to those skilled in the art. Accordingly, it is intended that the invention be limited only in terms of the appended claims.

What is claimed is:

1. A multiple row bearing assembly 26 for a rotating anode X-ray tube device 10 comprising:

an outer housing 28;

an inner bearing shaft 30;

an intermediate race 32 having an inner spiral grooved surface 34 and an outer spiral grooved surface 36 coupled between said outer housing 28 and said inner bearing shaft 30;

a first gallium layer 42 interposed between said inner spiral grooved surface 34 and said inner bearing shaft 36; and a second gallium layer 44 interposed between said outer spiral grooved surface 36 and the outer housing 28.

2. The bearing assembly 26 of claim 1 further comprising at least one additional intermediate race 32 coupled next to said intermediate race within said outer housing 28 and next to said inner bearing shaft 30.

3. The bearing assembly 26 of claim 1 further comprising:

at least one additional intermediate race coupled around said intermediate race 32 and within said outer housing 28, wherein each of said at least one additional intermediate races has a second inner spiral grooved surface and a second outer spiral grooved surface, wherein said second layer of gallium is interposed between said intermediate race and said adjacent one of said at least one intermediate race;

a third layer of gallium interposed between an outer one of said at least one intermediate race and said outer housing 28; and a fourth layer of gallium interposed between each of said at least one intermediate race.

4. The bearing assembly 26 of claim 1, wherein said outer housing 28 is coupled to a rotor and wherein said outer housing is coupled to a stem 24 of a rotating anode assembly 12, said outer housing 28 capable of rotating in response to the rotation of said rotor while said inner bearing shaft 30 remains relatively stationary.

5. A method for increasing the shaft velocity and anode power of an X-ray tube device 10 while limiting heat generation and torque transfer to non-rotating components, the method comprising the step of:

coupling a intermediate race 32 between a inner bearing shaft 30 and an outer housing 28 of the X-ray tube device 10, said intermediate race 32 having a spiral grooved inner surface 34 and an outer spiral grooved outer surface 36;

coupling a first gallium layer 42 between said spiral grooved inner surface 34 and said inner bearing shaft 30; and coupling a second gallium layer 44 between said spiral grooved outer surface 36 and said outer housing 28.

6. The method of claim 5 further comprising the step of coupling at least one additional intermediate race coupled next to said intermediate race within said outer housing 28 and next to said inner bearing shaft 30, wherein said first gallium layer 42 is also interposed between said at least one additional intermediate race and said inner bearing shaft 30 and said second gallium layer 44 is also interposed between said at least one additional intermediate race and said outer housing 28.

7. The method of claim 5 further comprising the steps of:

coupling at least one additional intermediate race coupled around said intermediate race 32 and within said outer housing 28, wherein each of said at least one additional intermediate races has a second inner spiral grooved surface and a second outer spiral grooved surface and wherein said second layer of gallium 44 is interposed between said intermediate race 32 and said adjacent one of said at least one additional intermediate race;

coupling a third layer of gallium between an outer one of said at least one additional intermediate race and said outer housing 28; and coupling a fourth layer of gallium between each of said at least one additional intermediate race.

8. The method of claim 5, wherein the step of coupling an intermediate race between a inner bearing shaft 30 and an outer housing 28 of the X-ray tube device 10, said intermediate race 32 having a spiral grooved inner surface 34 and a spiral grooved outer surface 36 comprises the step of coupling a intermediate race 32 between a rotating inner bearing shaft 30 and a stationary outer housing 28 of the X-ray tube device 10, said intermediate race having a spiral grooved inner surface 34 and a spiral grooved outer surface 36.

9. The method of claim 8 further comprising the step of coupling at least one additional intermediate race 32 next to said intermediate race within said stationary outer housing 28 and next to said rotating inner bearing shaft 30, wherein said first gallium layer is also interposed between said spiral grooved inner surface 32 and said rotating inner bearing shaft 30 and said second gallium layer 44 is also interposed between said spiral grooved outer surface 36 and said stationary outer housing 28.

10. The method of claim 8 further comprising the steps of:

coupling at least one additional intermediate race around said intermediate race 32 and within said stationary outer housing 28, wherein each of said at least one additional intermediate races has a second inner spiral grooved surface and a second outer spiral grooved surface and wherein said second layer of gallium 44 is interposed between said intermediate race 32 and said adjacent one of said at least one intermediate race;

coupling a third layer of gallium between an outer one of said at least one intermediate race and said stationary outer housing 28; and coupling a fourth layer of gallium between each of said at least one additional intermediate races.

11. The method of claim 5, wherein the step of coupling a intermediate race 32 between a inner bearing shaft 30 and an outer housing 28 of the X-ray tube device 10, said intermediate race 32 having a spiral grooved inner surface 34 and a spiral grooved outer surface 36 comprises the step of coupling a intermediate race 32 between a stationary inner bearing shaft 30 and a rotating outer housing 28 of the X-ray tube device 10, said intermediate race 32 having a spiral grooved inner surface 34 and a spiral grooved outer surface 36.

12. The method of claim 11 further comprising the step of coupling at least one additional intermediate race coupled next to said intermediate race 32 within said rotating outer housing 28 and next to said stationary inner bearing shaft 30, wherein said first gallium layer 42 is also interposed between said at least one additional intermediate race and said stationary inner bearing shaft 30 and said second gallium layer 44 is also interposed between said at least one additional intermediate race and said rotating outer housing 28.

13. The method of claim 11 further comprising the steps of:

coupling at least one additional intermediate race coupled around said intermediate race 32 and within said rotating outer housing 28, wherein each of said at least one additional intermediate races has a second inner spiral grooved surface and a second outer spiral grooved surface and wherein said second layer of gallium 44 is interposed between said intermediate race 32 and said adjacent one of said at least one additional intermediate race;

coupling a third layer of gallium between an outer one of said at least one intermediate race and said rotating outer housing 28; and coupling a fourth layer of gallium between each of said at least one additional intermediate race.

14. A rotating anode x-ray tube device 10 comprising:

a rotating anode assembly 12 having a stem 24;

a multiple row spiral grooved bearing assembly 26 coupled to said stem 24; and a motor for rotating said rotating anode assembly 12.

15. The X-ray tube device 10 of claim 14, wherein said multiple row spiral grooved bearing assembly 26 comprises:

an outer housing 28;

an inner bearing shaft 30;

an intermediate race 32 having an inner spiral grooved surface 34 and an outer spiral grooved surface 36 coupled between said outer housing 28 and said inner bearing shaft 30;

a first gallium layer 42 interposed between said inner spiral grooved surface 34 and said inner bearing shaft 30; and a second gallium layer 44 interposed between said outer spiral grooved surface 36 and said outer housing 28.

16. The X-ray tube device 10 of claim 15, wherein said multiple row spiral grooved bearing assembly further comprises at least one additional intermediate race coupled next to said intermediate race within said outer housing and next to said inner bearing shaft.

17. The X-ray tube device 10 of claim 15, wherein said multiple row spiral grooved bearing assembly 26 further comprises:

at least one additional intermediate race coupled around said intermediate race 32 and within said outer housing 28, wherein each of said at least one additional intermediate races has a second inner spiral grooved surface and a second outer spiral grooved surface, wherein said second layer of gallium 44 is interposed between said intermediate race 32 and said adjacent one of said at least one additional intermediate race;

a third layer of gallium interposed between an outer one of said at least one additional intermediate race and said outer housing 28; and a fourth layer of gallium interposed between each of said at least one additional intermediate race.

18. The X-ray tube device 10 of claim 15, wherein said outer housing 28 is coupled to a rotor of said motor and to said stem 24, said outer housing 28 capable of rotating in response to the rotation of said rotor while said inner bearing shaft 30 remains relatively stationary.

* * * * *